United States Patent [19]

Foley

[11] Patent Number: 4,461,732

[45] Date of Patent: Jul. 24, 1984

[54] ENGINE AIR INDUCTION SYSTEM

[75] Inventor: Kevin M. Foley, Rochester, N.Y.

[73] Assignee: General Motors Corporation, Detroit, Mich.

[21] Appl. No.: 459,782

[22] Filed: Jan. 21, 1983

[51] Int. Cl.[3] ..... F02M 7/22

[52] U.S. Cl. ..... 261/52; 261/50 A; 261/DIG. 18; 123/391

[58] Field of Search ..... 261/DIG. 18, 52; 123/378, 391; 261/50 A

[56] References Cited

U.S. PATENT DOCUMENTS

| | | | |
|---|---|---|---|
| 2,040,254 | 5/1936 | Gerald | 261/52 |
| 2,082,710 | 6/1937 | Mallory | 261/52 |
| 2,195,867 | 4/1940 | Mallory | 261/52 |
| 2,832,576 | 4/1958 | Henning . | |
| 2,977,101 | 3/1961 | Carlson | 261/52 |
| 3,272,482 | 9/1966 | Carlson . | |
| 3,284,060 | 11/1966 | Kalert, Jr. . | |
| 3,294,375 | 12/1966 | Szwargulski . | |
| 3,309,069 | 3/1967 | Braun et al. . | |
| 3,322,408 | 5/1967 | Stoltman . | |
| 3,396,948 | 8/1968 | Stettner . | |
| 3,575,391 | 4/1971 | Braun et al. . | |
| 3,796,413 | 3/1974 | Woods . | |
| 3,896,195 | 7/1975 | Harrison . | |
| 3,906,910 | 9/1975 | Szlaga, Jr. . | |
| 3,937,768 | 2/1976 | Bier et al. . | |
| 4,005,161 | 1/1977 | Shimo et al. . | |
| 4,105,720 | 8/1978 | Hohsho et al. . | |
| 4,119,684 | 10/1978 | Karino . | |
| 4,159,290 | 6/1979 | Honma et al. . | |

FOREIGN PATENT DOCUMENTS

| | | | |
|---|---|---|---|
| 1281746 | 10/1968 | Fed. Rep. of Germany | 261/52 |
| 731883 | 9/1932 | France | 261/52 |
| 958915 | 5/1964 | United Kingdom | 261/50 A |
| 2034823 | 6/1980 | United Kingdom . | |

*Primary Examiner*—Tim R. Miles

*Attorney, Agent, or Firm*—C. K. Veenstra

[57] ABSTRACT

In an engine air induction passage, a throttle controls air flow and an air valve is biased to a position which is a measure of the air flow. Linkage between the throttle and the air valve opens the air valve as the throttle is opened and closes the air valve as the throttle is closed; the linkage contains a dashpot which allows the air valve to move gradually from the position to which it is urged by the throttle to its air flow measuring position.

1 Claim, 1 Drawing Figure

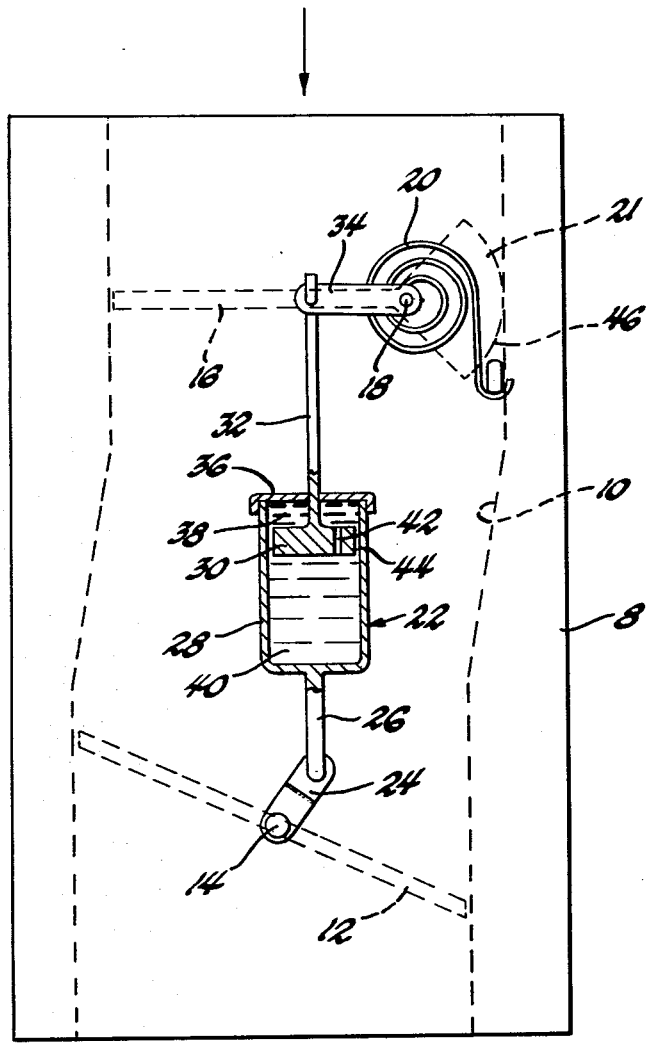
20
21
34
46
16
18
32
36
10
38
42
30
44
22
8
28
40
26
24
14
12

ENGINE AIR INDUCTION SYSTEM

TECHNICAL FIELD

This invention relates to an induction system for engine air flow.

BACKGROUND

In a conventional automotive spark ignition internal combustion engine, the vehicle operator varies the position of a throttle in an engine air induction passage to control air flow through the induction passage to the engine. The induction air flow is measured, and fuel is delivered to the engine in a desired proportion to the measured air flow.

One mechanism for measuring engine induction air flow is an air valve disposed in the induction passage upstream of the throttle. An opening force on the air valve is created by the difference between the pressures in the induction passage upstream and downstream of the air valve; in some instances the pressures are applied to opposite sides of a diaphragm which transmits the force through a link connected to the air valve, while in other instances the pressures act directly on the air valve. The opening force created by the pressure difference is opposed by the closing bias of a member such as a spring or counterweight, and the air valve accordingly seeks a position which balances the opening force against the closing bias. In many applications, the closing bias is a constant force, and the pressure difference across the air valve is thus the same for all positions of the air valve. The air flow area around the air valve is therefore proportional to the air flow through the induction passage, and the position of the air valve is thus a measure of the air flow through the induction passage.

In applications where the closing bias is not a constant force, the pressure difference across the air valve will not be the same for all positions of the air valve. In those applications, however, each position of the air valve will represent both the air flow area around the air valve and the pressure difference across the air valve, and the position of the air valve will thus be a measure of the air flow through the induction passage.

In a carbureted engine, the air valve may be connected to a fuel metering rod to control fuel flow in the desired proportion to air flow. In other engines, the position of the air valve may be measured, such as by a resistive position sensor, and fuel flow to the engine may be controlled electronically in accordance with the position signal from the sensor to provide fuel flow in the desired proportion to air flow.

SUMMARY OF THE INVENTION

This invention provides an improved engine air induction system in which induction air flow is measured by an air valve.

In an engine air induction system according to this invention, a linkage connects the air valve and the throttle to open the air valve as the throttle is opened and to close the air valve as the throttle is closed. The air valve is biased to a position which is a measure of the induction air flow, and the linkage includes a dashpot which allows the air valve to move gradually from the position to which it is urged by the throttle to its air flow measuring position.

In an induction system according to this invention, therefore, movement of the throttle to change the induction air flow causes movement of the air valve toward a position which is indicative of the anticipated induction air flow. As the throttle is opened to increase air flow through the induction passage, the air valve is opened to indicate increased air flow, and as the throttle is closed to decrease air flow through the induction passage, the air valve is closed to indicate a decreased air flow. The fuel delivery system accordingly may increase fuel flow as the throttle is opened to avoid a lean mixture as air flow increases and, if desired, to enrich the mixture for engine acceleration. Similarly, the fuel delivery system may decrease fuel flow as the throttle is closed to avoid a rich mixture as the air flow decreases and, if desired, to lean the mixture for engine deceleration.

The advantages of this invention are achieved without compromising the ability of the air valve to provide a measure of the induction air flow during steady state conditions—when the throttle is held stationary, the dashpot allows the air valve to move to its air flow measuring position.

The details as well as other features and advantages of the preferred embodiment of this invention are set forth in the remainder of the specification and are shown in the accompanying drawing.

SUMMARY OF THE DRAWING

The sole FIGURE of the drawing is a schematic view of the preferred embodiment of this engine air induction system.

THE PREFERRED EMBODIMENT

Referring to the drawing, an inlet body 8 defines an engine air induction passage 10 containing a throttle 12 mounted on a throttle shaft 14. Throttle 12 is operated through a conventional link or cable (not shown) connected to throttle shaft 14 to control air flow through induction passage 10.

An air valve 16 is also disposed in induction passage 10 on an air valve shaft 18. Air valve shaft 18 is offset to one side of induction passage 10 so the difference in pressure across air valve 16 created as air flows through induction passage 10 biases air valve 16 and air valve shaft 18 in a counterclockwise direction. Counterclockwise rotation of air valve 16 and air valve shaft 18 is opposed by the bias of a spiral spring 20. Counterclockwise rotation of air valve 16 and air valve shaft 18 is also opposed by the counterweighting or clockwise bias of the enlarged portion 21 of air valve 16. As explained above, the bias of spring 20 and counterweight portion 21 causes air valve 16 to assume a position which is a measure of air flow through induction passage 10.

Throttle 12 and throttle shaft 14 are connected to air valve 16 and air valve shaft 18 through a linkage 22 which includes a throttle lever 24 secured to throttle shaft 14, a lower link 26 pivotally connected to throttle lever 24, a dashpot housing 28 secured to lower link 26, a dashpot piston 30 disposed in housing 28, an upper link 32 secured to piston 30, and an air valve lever 34 secured to air valve shaft 18 and pivotally connected to upper link 32.

Dashpot housing 28 has a cover 36 which seals about upper link 32 to provide closed chambers 38 and 40 within housing 28 above and below piston 30. Chambers 38 and 40 are connected through a restricted orifice 42 formed in piston 30, through the restricted peripheral gap 44 between piston 30 and housing 28, or through both orifice 42 and peripheral gap 44.

As throttle 12 is moved clockwise from the closed position illustrated toward a wide open position to increase air flow through induction passage 10, throttle lever 24 pulls lower link 26 downwardly and the dashpot housing 28 with its cover 36 tends to compress the fluid in chamber 38 to move piston 30 downwardly. The downward motion of piston 30 is transmitted through upper link 32 and air valve lever 34 to urge air valve 16 counterclockwise toward a position which is indicative of the anticipated increased air flow. When throttle 12 is stationary, the pressure differential acting on air valve 16 and the opposing bias of spring 20 and counterweight portion 21 acting on air valve 16 force air valve 16 to a position which is a measure of air flow through induction passage 10. As air valve 16 is forced toward that position, piston 30 is moved within housing 28 and fluid is transferred between chambers 38 and 40 through restricted orifice 42 and/or restricted peripheral gap 44. The dashpot formed by housing 28 and piston 30 thus permits gradual movement of air valve 16 from the position to which it is urged by throttle 12 to the position which is a measure of air flow through the induction passage.

As throttle 12 is moved counterclockwise from an open position toward the closed position shown, throttle lever 24 pushes lower link 26 and dashpot housing 28 upwardly to increase the pressure in chamber 40. Piston 30 is then moved upwardly, and the motion of piston 30 is transmitted through upper link 32 and air valve lever 34 to urge air valve 16 toward a position which is indicative of the anticipated decreased air flow. When throttle 12 is again stationary, fluid is transferred between chambers 38 and 40 through restricted orifice 42 and/or restricted peripheral gap 44 to allow air valve 16 to assume the position which is a measure of the new air flow through induction passage 10.

In the preferred embodiment illustrated, induction passage 10 has a rectangular cross section and the arcuate surface 46 on the counterweight portion 21 of air valve 16 seals against the induction passage wall.

The embodiments of the invention in which an exclusive property or privilege is claimed are defined as follows:

1. An engine air induction system comprising means defining an induction passage for air flow to the engine, a throttle disposed in said induction passage and movable between closed and wide open positions for controlling air flow therethrough, an air valve disposed in said induction passage and movable between closed and wide open positions, means biasing said air valve to a position which is a measure of air flow through said induction passage, and a linkage connecting said air valve and said throttle for urging said air valve toward its wide open position as said throttle is moved toward its wide open position and for urging said air valve toward its closed position as said throttle is moved toward its closed position, and wherein said linkage includes a dashpot permitting movement of said air valve at a restricted rate from the position to which it is urged by said linkage to the position to which it is biased by said biasing means, whereby said air valve assumes a position which is a measure of air flow through said induction passage when the position of said throttle remains constant, and whereby said air valve is moved toward a position which is indicative of anticipated air flow as said throttle is moved to change the air flow through said induction passage.

* * * * *